United States Patent [19]

Warhol

[11] Patent Number: 4,486,090

[45] Date of Patent: Dec. 4, 1984

[54] COPY MACHINE WITH UNAUTHORIZED COPY PREVENTION

[75] Inventor: Nicholas Warhol, Minneapolis, Minn.

[73] Assignee: Minnesota Mining and Manufacturing Company, St. Paul, Minn.

[21] Appl. No.: 477,061

[22] Filed: Mar. 21, 1983

[51] Int. Cl.[3] ..... G03G 15/00

[52] U.S. Cl. ..... 355/3 R; 355/133

[58] Field of Search ..... 355/133, 3 CH, 14 CH, 355/3 R, 8; 361/180

[56] References Cited

PUBLICATIONS

*IBM Technical Disclosure Bulletin:* vol. 15, No. 9, Feb. 1973, pp. 2736–2737, "Secure Document Feature for Copy Machines."

*IBM Technical Disclosure Bulletin:* vol. 15, No. 12, May 1973, p. 3642, "Unauthorized Copy Prevention."

*IBM Technical Disclosure Bulletin:* vol. 16, No. 6, Nov. 1973, pp. 1951–1952, "Gradiometer Document Detector for Copy Security."

*IBM Technical Disclosure Bulletin:* vol. 17, No. 11, Apr. 1975, p. 3182, "Copier Document Security," p. 3198, Secure Document Feature for Copy Machine.

*IBM Technical Disclosure Bulletin:* vol. 18, No. 4, Sep. 1975, p. 1002, "Secure Document Feature for Copy Machine."

*Primary Examiner*—John F. Gonzales

*Assistant Examiner*—J. Pendegrass

*Attorney, Agent, or Firm*—Donald M. Sell; James A. Smith; Robert L. Marben

[57] ABSTRACT

A copy machine having an eddy current proximity detector positioned so relative movement is provided between the detector and a document to be copied. The detector is connected to control logic circuitry for the copy machine so that the copy machine is prevented from producing a copy when the detector detects metal carried by the document. A document cover position indicating device is also connected to the control logic for the copy machine so that closure of the document cover is required for the production of a copy.

8 Claims, 7 Drawing Figures

COPY MACHINE WITH UNAUTHORIZED COPY PREVENTION

BACKGROUND OF THE INVENTION

The invention presented herein relates to copy machines having circuitry for detecting the presence of metal carried by an original sought to be copied and upon this detection of the presence of metal providing a signal for inhibiting operation of the copy machine for making a copy from such original. More particularly, the invention relates to the use of an eddy current or inductive proximity switch as the detector for such circuitry and its use in a copy machine in which an optical scan of an original to be copied is used in making a copy.

Situations exist in government and industry involving security sensitive documents which are kept in areas where personnel having access to such documents also have access to a copy machine. The need for making copies of non-sensitive documents in such situations must be balanced with the need that unauthorized copies not be made of sensitive documents. One solution is to have a copy machine, the operation of which is inhibited when a sensitive document is presented to the machine for copying.

BRIEF DESCRIPTION OF THE PRIOR ART

Prior art solutions to provide such a copy machine can be placed in two broad approaches. One approach involves the use of optics for detection of an original which is not to be copied. A signal for inhibiting copy machine operation is produced when such an original is detected. This approach is objectional in that it requires the use of special paper when preparing printed or typed originals of a sensitive document. This makes it very difficult or impossible to condition or treat existing sensitive documents so they can be optically detected to provide a complete solution to the problem.

A second approach for the detection of sensitive documents to be copied involves some form of electrical detection. This includes the use of metal foil backed originals which cause a change in the inductance of a coil that is etched in the document plane of the copier and is connected to a high-Q tuned circuit. The output voltage of the high-Q circuit is changed by a change in the inductance of the coil and is used to provide a control signal to disable the copier. The coil surrounds the area in which the original is placed. This is disclosed in an IBM Technical Disclosure Bulletin, Vol. 15, No. 9, February 1973, which also mentions the possibility of etching conductive elements to provide a high capacitive effect betwen adjacent conductors which is substantially changed when a metal foil backed original is positioned for copying. A similar coil is also disclosed in IBM Technical Disclosure Bulletin, Vol. 15, No. 12, May 1973, wherein conductive paper is used for the original which serves to change the frequency output of an oscillator that includes the coil. The change in frequency is detected by comparison with a reference oscillator. IBM Technical Disclosure Bulletin, Vol. 16, No. 6, November 1973, discloses the use of a magnetic field generator plus magnetic field detector coils that are placed in the magnetic field and in close proximity to the document plane in the copy machine to detect a change in the generated flux field when a foreign metallic object is placed within the field such as by an original with metal flag or metal back coating to provide an output signal which actuates a copier disable control.

The prior electrical detection approaches use sensors that cover a large area so as to surround or encompass the entire original and require the original to use large metal areas and/or special metals. In addition, none of the detection approaches provide a means for checking the operability of the detector circuitry.

SUMMARY OF THE INVENTION

The present invention avoids the problems associated with prior art approaches for preventing the copying of a security sensitive document by an office copier. The present invention also includes integration of the detection function into the machine operation in such a manner that it does not interfere with the normal operation of the copy machine with such integration also providing safeguards for preventing circumvention of the detection function. The present invention also provides for a check of the operability of the detector during operation of the copier.

The invention presented herein is embodied in a copy machine of the type that has a document cover that can be positioned over a document presented to a platen in the copy machine for copying and has control logic circuitry for controlling the copying process of the copy machine which uses a charge corona control for operation of a charge corona to supply a uniform charge to a photoconductor and a transfer corona control for operation of a transfer corona. The invention provides such a copy machine with an eddy current proximity detector which has an output connected to the control circuitry and is positioned so relative movement is provided between the eddy current proximity detector and a document to be copied when the copy machine is operated. The detector is adapted for providing a signal at its output when metal is presented to the detector. A latching means is provided which is operatively connected to the output of the detector and to the control logic circuitry. The latching means provides a latch condition when the control logic circuitry provides an enable signal to the latching means at the time a detector output is provided. The control logic circuitry provides an enable signal to the latching means when relative movement is provided between the eddy current proximity detector and a document to be copied in a manner such that the signal output from the eddy current proximity detector that is provided due to metal present at the document to be copied is effective to cause the latching means to present a latched condition. The invention further provides for the control logic circuitry to be operatively connected to the charge corona control, transfer corona control and to the latching means such that the control circuitry inhibits operation of the charge corona control and transfer corona control when the latching means provides a latch condition. With this invention, a copy machine is provided wherein a sensitive document which carries metal cannot be copied.

Another aspect of the invention relates to the provision of a document cover position detector that is operatively associated with the document cover and operatively connected to the control logic circuit for providing an electrical indication of the open-closed status of the document cover. The control logic circuitry requires the electrical indication provided by the document cover position detector to reflect a closed status for the document cover before a copy process cycle can begin and inhibits the operation of the charge corona control and transfer control when a document cover open status is presented after a copy process cycle has begun. By using the document cover position detector aspect of the invention, the integrity of the copy with respect to the prevention of the copying of a document that carries metal is enhanced.

Another aspect of the invention is specific to an arrangement wherein the relative movement provided between said eddy current proximity detector and a document to be copied is provided after the document to be copied is positioned on the platen. This is implemented, for example, by placing the detector on the scanning apparatus that may be present in a copy machine.

The latching means provided by the invention presented herein can include a drive circuit that is connected to the output of the detector with a latching relay connected to the drive circuit which, when operated by the drive circuit, provides the latch condition.

Another aspect of the invention relates to an arrangement whereby a signal from the output of the detector can be provided that is usable to verify operability of the detector. This is provided, for example, by positioning metal for detection by the eddy current detector during a portion of movement of the detector when the eddy current detector is arranged for movement with the document in position at the platen.

Since an enabling signal is provided to the latching means when the detector is positioned for sensing metal that might be present on a document to be copied and is not provided when sensing metal positioned so the detector can provide a signal usable for verifying operability of the detector, the position of the detector must be known by the control logic circuitry. An aspect of the invention relates to this timing problem and provides for a pulse generator to provide a series of pulses to the control logic circuitry with a position indicator operatively connected to the control logic circuitry and positioned for actuation at a point in the movement of the eddy current detector to provide a timing reference. Such actuation is usable to provide a starting point for utilization of the series of pulses for determining when an enabling signal is provided to the latching means.

BRIEF DESCRIPTION OF THE DRAWINGS

The novel features and advantages of the present invention will become more apparent to those skilled in the art after reading the following detailed description which refers to the accompanying drawings in which like elements are designated by identical reference numerals in the various figures and wherein.

DETAILED DESCRIPTION

Figure 1:
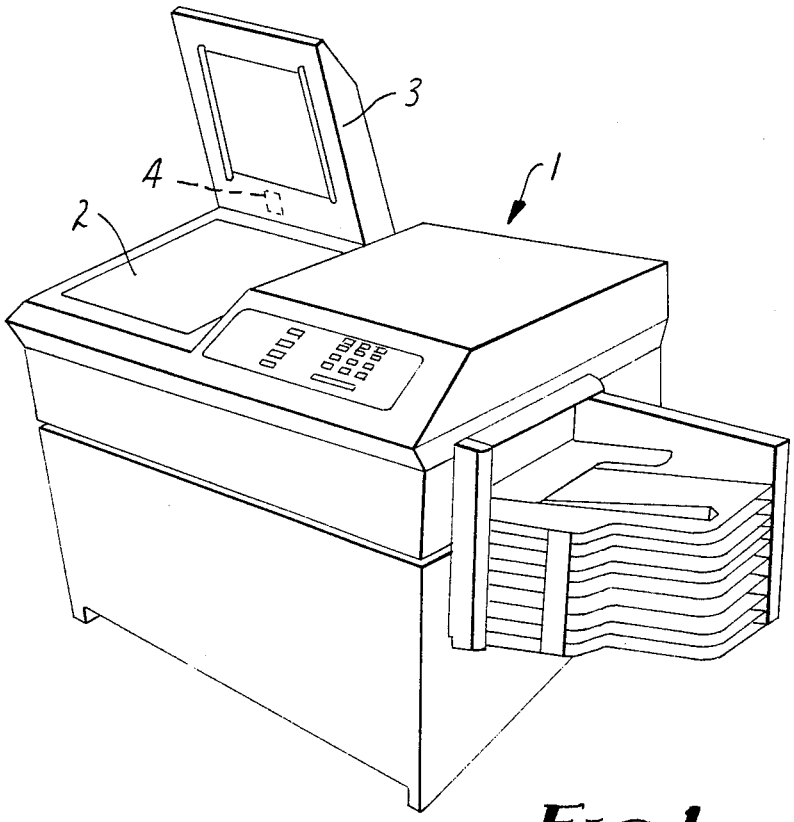
FIG. 1 is a perspective view of a copy machine.

Referring to FIG. 1, a copy machine 1 is shown of the type wherein a document to be copied is placed on a transparent platen 2 for optical scanning by a scanning mechanism positioned below the platen. While a simple cover is used in some copy machines to cover and hold the document to be copied against the platen during the scanning process, the copy machine shown is of the type that has an automatic feed mechanism or document loader mounted in the cover 3 enabling a number of documents to be copied to be placed in position on the cover which are then moved one at a time to a copying position on the platen. The document loader includes a detector, such as a photocell arrangement, to determine whether a document or sheet is present at the input to the document loader. Document loaders of this type are well known and are used with many office copiers manufactured by a number of companies. The present invention requires that the open-closed position of the cover be sensed to provide an electrical indication of the open-closed position to control logic circuitry for the copier. A document cover position indicating device can be provided by a mercury switch positioned within the cover, indicated by the enclosed dotted line 4 at the cover 3. The switch is positioned so a closed switch condition indicates one position for the cover while an open switch condition indicates the other position for the cover.

The embodiment of the invention that will be described involves modification in accordance with the invention presented herein of a copy machine manufactured and sold by the Minnesota Mining and Manufacturing Company, St. Paul, Minn., under the model designation 787 which, except for the document cover position indicating device, has the features described above in connection with FIG. 1.

Figure 2:
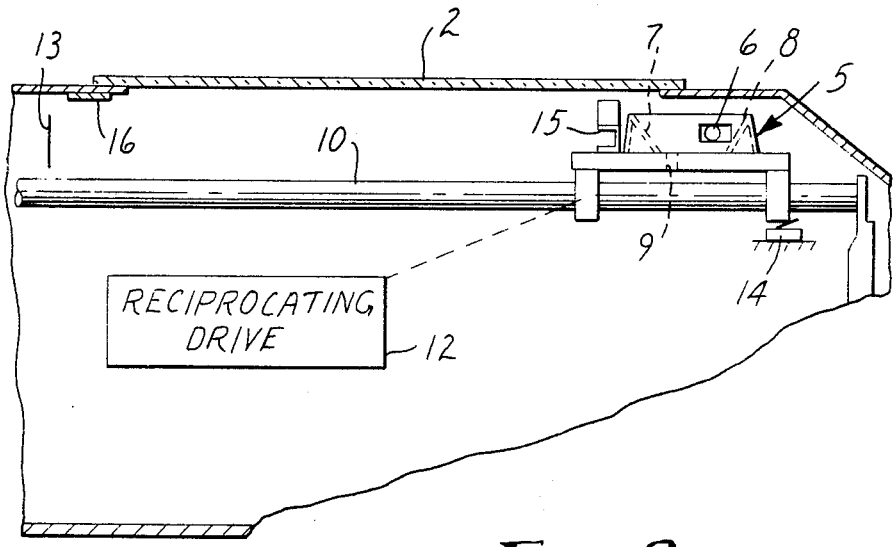
FIG. 2 is a fragmentary vertical section of a copy machine according to the present invention.

Referring to FIG. 2, a vertical section view is shown illustrating the portion of the optical scanning apparatus of the aforementioned copy machine that is utilized for implementation of the invention. The scanning apparatus includes a carriage 5 which supports a lamp 6 between two reflecting surfaces 7 and 8 which direct light from the lamp 6 toward the platen 2 to illuminate a document to be copied that is positioned on the upper surface of the platen 2. The frame of the carriage is formed with a slot-shaped exposure aperture 9 through which light reflected from the document to be copied is directed to the photoconductor drum 18 (FIG. 3) via the remaining light image directing portion (not shown) of the copy machine. The carriage 5 is supported for movement along shafts 10 and 11 (FIG. 3) which are positioned parallel to the platen 2. A reciprocating drive 12, shown diagrammatically in FIG. 2, functions to move the carriage 5 from a start position, which is a short distance to the left of the position shown in FIG. 2, thence to the right to the position shown in FIG. 2, then to the left to a position indicated by the line 13 with return movement to the right provided to bring the carriage back to the starting position. It is during the last movement to the right that the light image is utilized by the photoconductor 18 (FIG. 3) to establish a latent charged image at the photoconductor. Further details concerning the scanning apparatus to include the optics path and reciprocating drive 12 are set forth in detail in U.S. Pat. No. 4,035,075 issued to Charles G. Sprado which is incorporated herein by reference. A position detector 14, which may take the form of a switch, is positioned as shown in FIG. 2 to provide a reference point with respect to the position of the carriage 5 which, as will be explained, is utilized by the control logic circuitry for the copy machine.

The invention presented herein utilizes an eddy current proximity detector. Eddy current proximity detectors are known and includes a high-frequency oscillator circuit, which includes a coil with an amplifier connected to respond to the output of the oscillator and provide a signal reflecting changes in the output of the oscillator. Eddy current proximity detectors are useful for detecting metal entering or leaving the detection area of the detector. When no metal is present, a small high-frequency field radiates from the coil of the detector and the oscillator of the detector functions normally. Metal presented to the high-frequency field absorbs the high-frequency energy lowering the activity of the oscillator to provide an output which can be utilized to operate a load device. In the case of the present invention, the coil for an eddy current detector 15 is positioned on the carriage 5 so that the coil is a short distance below the platen 2. Metal carried by a document presented at the platen 2 for copying can be detected as the carriage moves relative to the document. Such detection, as will be explained, is used to prevent the copy machine from making a copy of such a document. The oscillator and amplifier portion (not shown) of the eddy current proximity detector 15 is located at a convenient point in the copy machine that is remote from the carriage 5. For redundancy, more than one eddy current detector can be used with the coil for each mounted on the carriage 5. A piece of metal 16 can be positioned outside the document scan portion of the platen 2 at a point where it will be detected by the eddy current proximity detector(s) during movement of the carriage 5. Such detection can be used to provide a signal that is usable by the control logic circuitry to verify the operability of the eddy current proximity detector and thus enhance the integrity of the copy machine with respect to its functioning to prevent the copying of a metal bearing document.

Before any consideration is given to a description of the control logic circuitry and the peripheral input and output circuitry operatively connected to the control logic circuitry relative to the use of the eddy current detector and the document cover position detector, further description is needed with respect to the various elements that are involved with respect to the copying process that is provided by the copy machine. In this connection, reference is made to FIG. 3 which provides a fragmentary vertical sectional view of the apparatus of FIG. 2 that is transverse to the movement of the carriage 5 which also provides a general view of the various elements of the copy machine that are involved for receiving the light image for further processing to produce a copy of the document scanned. The light image from the scanning mechanism is directed by the optics (not shown) through a clear window 17 onto the photoconductive layer 18 provided at the outer curved surface of a cylindrical drum 19 that is synchronously rotated upon its axis 20 by drive apparatus 30 which is depicted schematically. As the drum 19 rotates upon its axis 20, its surface is presented successively to a number of processing elements or stations. For purposes of this disclosure, the various processing stations disposed about the drum are described functionally only. Starting from the upper portion of the drum, as shown in FIG. 2, and proceeding counterclockwise, the first element or station is a lamp 21 which is energized to initially condition the photoconductive layer 18 to receive a uniform electrostatic charge when the next station, a charge corona 22, is operated. The charged portion of the photoconductor then passes the exposure station where it is exposed to the light image that passes through the window 17 to establish an electrostatic latent image in accordance with the light image. Movement of the drum then presents the latent image to a developing station 23 where a suitable developer material, such as toner powder, is brought in contact with the photoconductor on the drum by a roller 24 of the developing station to develop the latent image. The toner adheres to the photoconductive layer in accordance with the latent image. The drum continues movement to move the develped latent image past a pretransfer A.C. corona 25 which serves to reduce the force of attraction between the toner powder and the photoconductive layer. The drum then moves the developed latent image on the drum past a transfer station 26 where a receptor sheet, such as paper, brought from the supply of receptor sheets 49 is presented to the photoconductor, while a transfer corona 27 of the transfer station 26 is energized. Movement of the receptor sheets is determined by the drive apparatus 30 which is depicted by the dotted line 33 as operatively connected drive rolls 34–36 for moving a receptor sheet to the transfer station 26. An A.C. corona 28 and a stripper 29 are positioned to act on the receptor sheet as it moves through the transfer station 26 to remove the receptor sheet from the surface of the photoconductor 18. Continuing counterclockwise about the drum, a lamp 31 is provided, which when energized, causes any electrostatic charge remaining at the photoconductor to be discharged. The drum then moves to a cleaning station 32 which removes any toner that may be present on the photoconductor.

Figure 4:
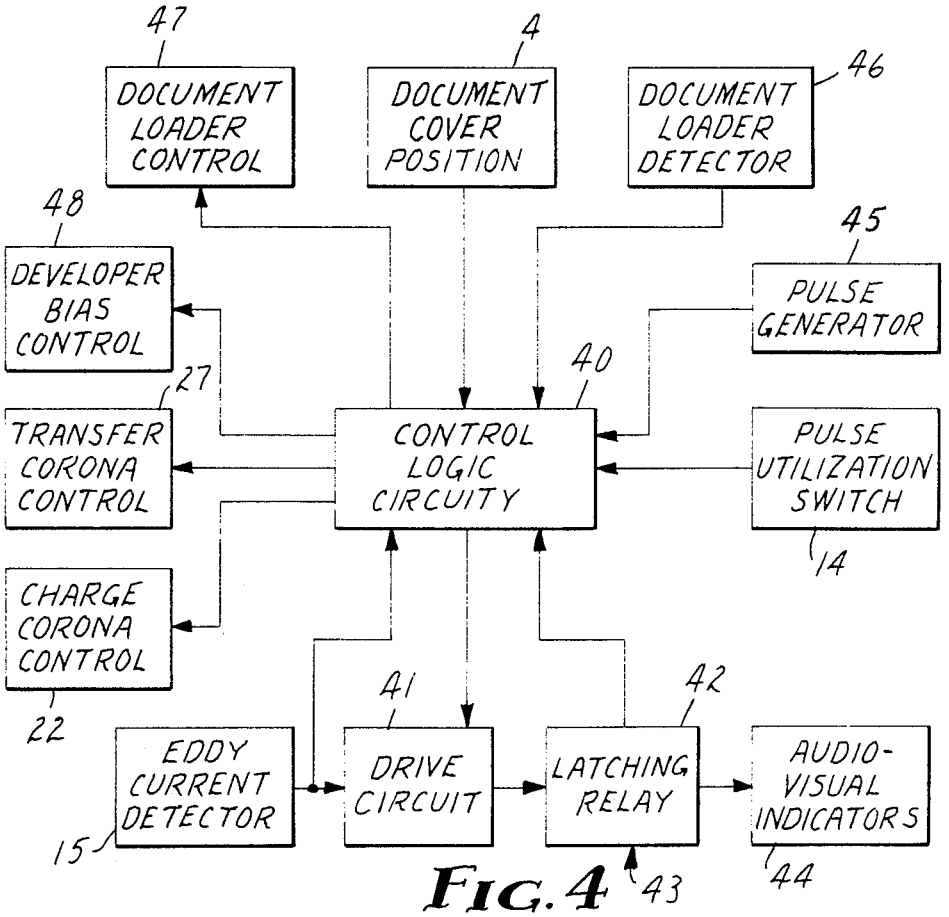
FIG. 4 is a block diagram of the circuitry related to the present invention.

Referring to FIG. 4, circuitry is shown that is pertinent to the operation of the copy machine with relation to the eddy current proximity detector 15 and document cover position detector 4. The circuitry includes a control logic circuitry 40 that can be provided by a microprocessor and associated programmed memory. The output of the eddy current proximity detector 15 is operatively connected to the control logic circuitry 40 and a latching means. The latching means includes drive circuit 41 which has its output operatively connected to a latching relay 42. The drive circuit 41 is also operatively connected to the control logic circuitry 40 and must receive an enable signal from the control logic circuitry 40 before it can respond to the output of the eddy current proximity detector 15 to provide a signal to operate the latching relay 42. The latching relay 42 includes a set of contacts that are monitored by the control logic circuitry 40 so the status of the latching relay 42 will be known by the control logic circuitry 40 and utilized to prevent the copy machine from producing a copy of a document presented to the platen 2. A manually controlled input 43 is provided so the latching relay 42 can be manually reset if it is operated by the drive circuit 41. The input 43 can be arranged so that it requires a key for operation to limit the number of people that can reset the latching relay 42. The latching relay 42 is connected so perceptible indication or indications are provided when the latching relay 42 is operated and is thus shown connected to audio-visual indicators 44, such as a light and buzzer or horn, which are energized when the latching relay 42 is operated by the drive circuit 42.

Continuing counterclockwise about the control logic circuitry 40, a pulse utilization switch 14 and pulse generator 45 are shown connected to the control logic circuitry. The pulse utilization switch 14 corresponds to the switch 14 shown in FIG. 2 which is operated when the carriage 5 has moved to the position shown in FIG.

2. Operation of the switch 14 signals the control logic circuitry 40 to begin utilizing the pulses provided by the pulse generator 45 to establish where the scanning apparatus, which include the carriage 5 and the coil for the eddy current proximity detector, is in a scanning cycle in order that various elements of the copy machine can be operated to provide the desired functioning of the copy machine. The pulse generator 45 can be provided by a photocell and light source that are positioned to detect each tooth of a gear as it moves past the photocell. A gear can be used that is driven directly by the motor for the drive apparatus 30 which is also the prime mover for the reciprocating drive 12 for the scanning apparatus for the copy machine as shown in FIG. 2. Pulses will thus be supplied to the control logic circuitry 40 before the pulse utilization switch 14 is operated, but will not be used until switch 14 is operated.

The next item shown connected to the control logic circuitry 40 is a document loader detector 46 which senses the presence of a document at the automatic loader provided in the document cover 3. The detector 46 can take the form of a simple photocell detector wherein a light path to a photocell is interrupted by a document to signal its presence in the document loader. Placement of a document in the document loader can be used to initiate operation of the copy machine without requiring the operator to operate a start switch.

The next block in FIG. 4 is for the document cover position indicating device 4 which serves to provide the control logic circuitry with an indication of the position for the document cover 3. Block 47 designates the control for operation of the automatic document loader provided in the document cover 3 which when operated serves to remove any document that may be present at the platen 2 and moves a document to be copied from the document loader input to the platen 2.

Figure 3:
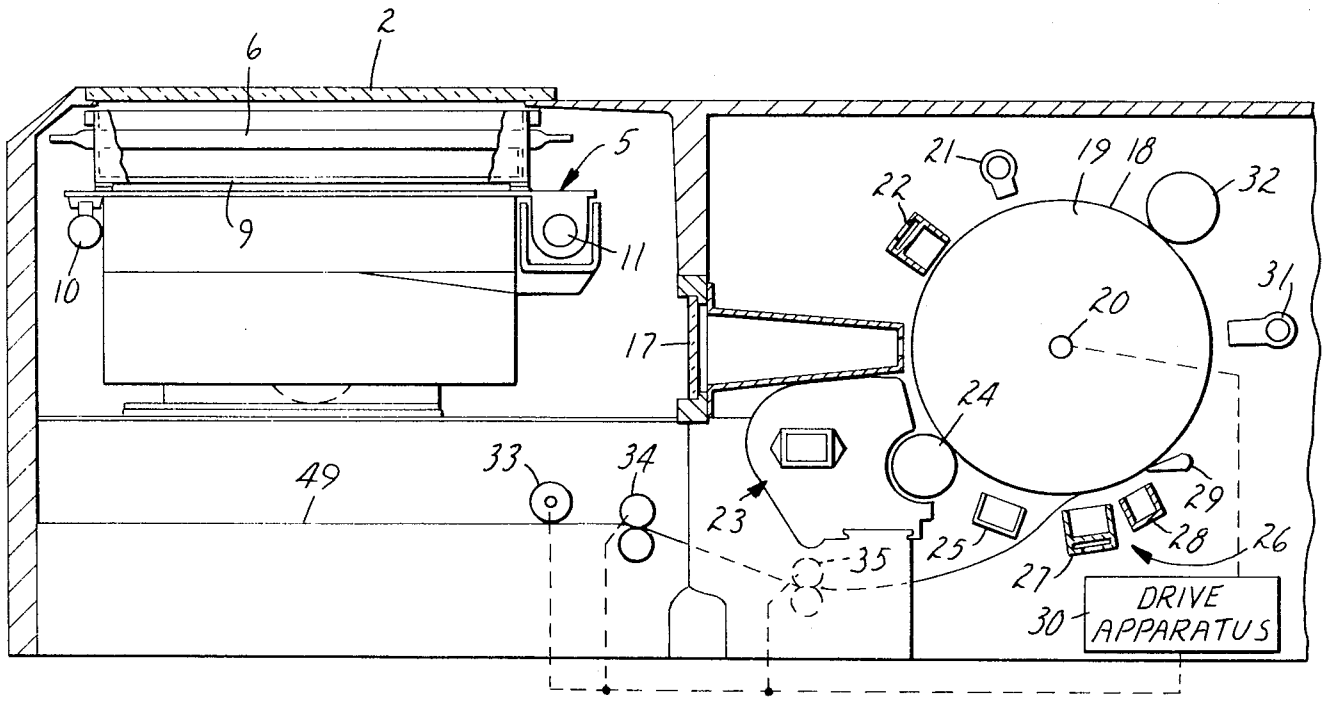
FIG. 3 is a fragmentary vertical sectional view that is transverse to the view in FIG. 2.
Figure 7:
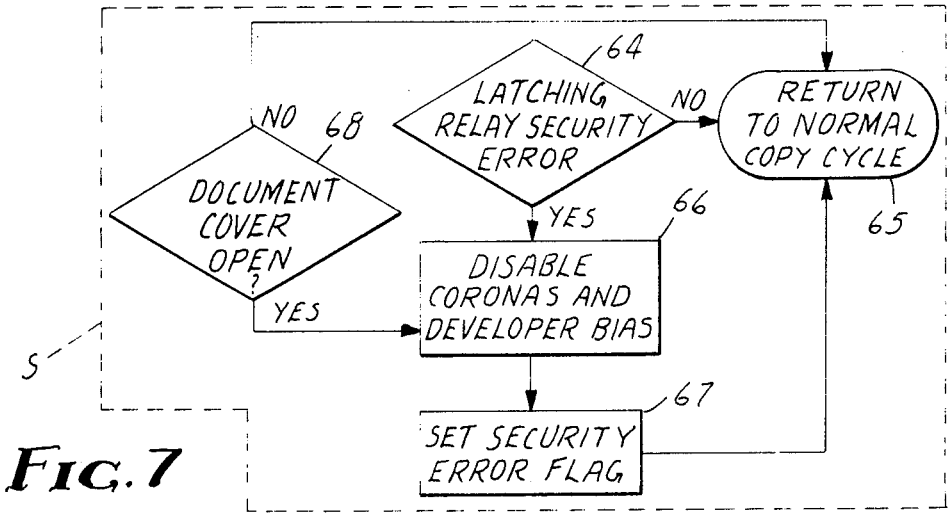
FIGS. 5, 6 and 7 are flow diagrams related to the circuitry of FIG. 4 and operation of the copy machine according to the present invention.
Figure 5:
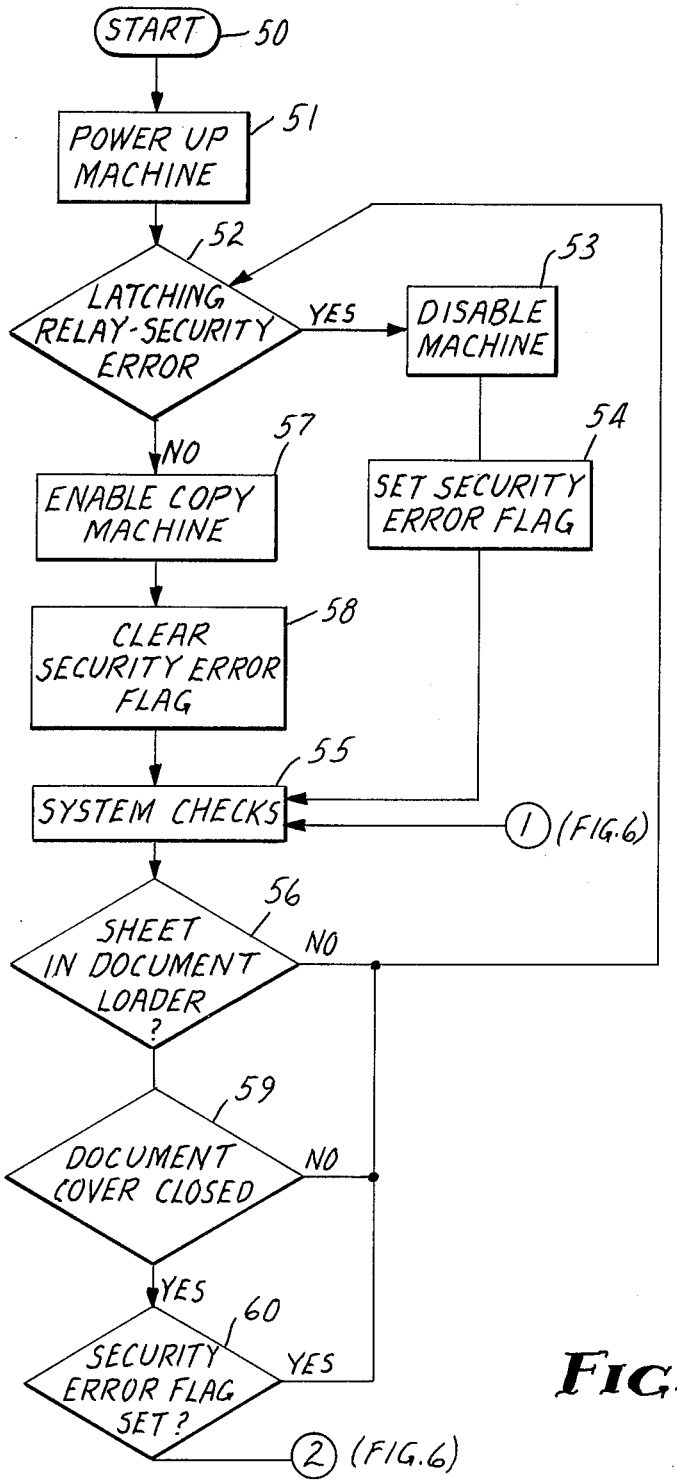
Figure 6:
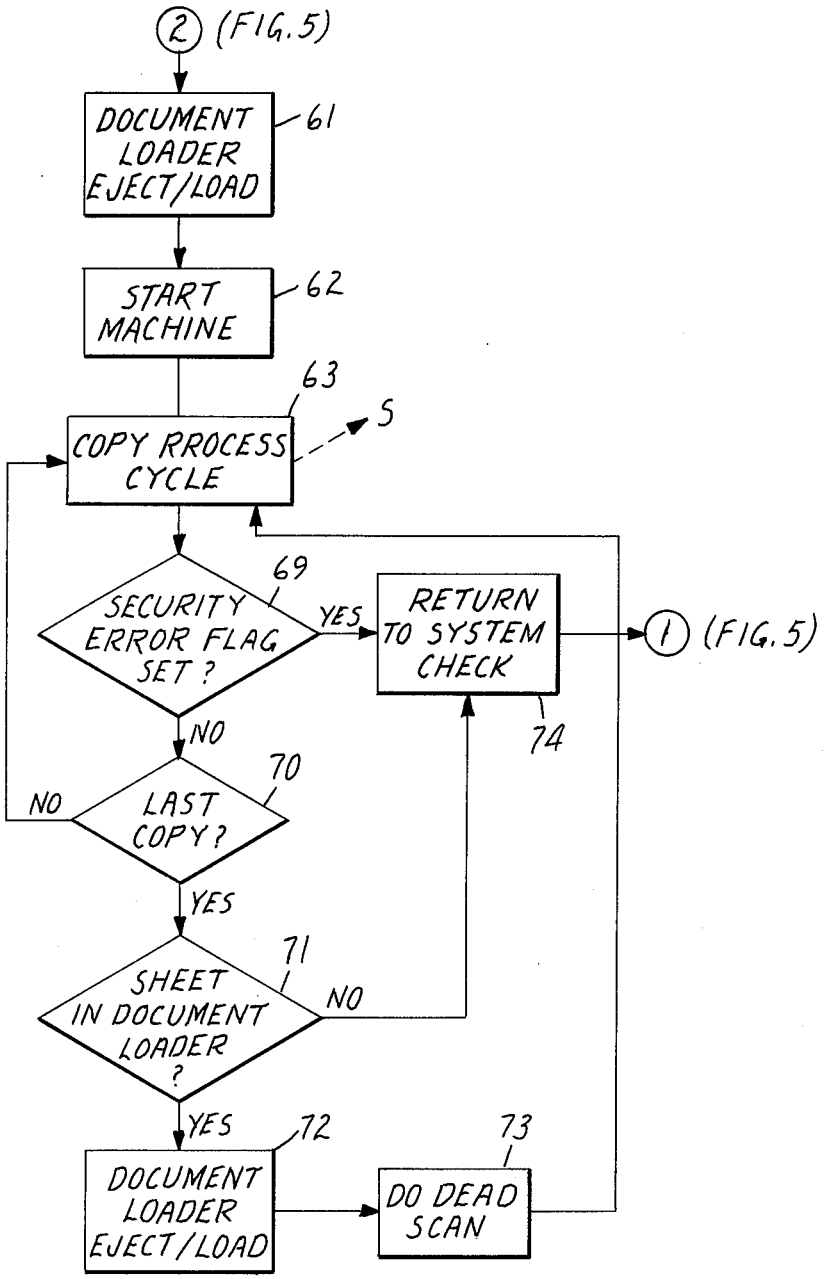

Though not indicated in connection with the developer station 23 shown in FIG. 3, the roller 24 may be provided with a bias voltage which is useful in the development of the latent image presented by the photoconductor 18 to the developer station 23. If the bias voltage is not present, less toner is transferred to the photoconductive layer 18 to develop the latent image. Application of the developer bias is controlled by the control logic circuitry 40 which is shown connected to the developer bias control 48. Control of the transfer corona 27 and control of the charge corona 22 by the control logic circuitry 40 is also pertinent to the use of the eddy current detector 15 with the copy machine to prevent the production of a copy when a document having metal is presented to the copy machine for copying. Such control of coronas 22 and 27 is indicated by the transfer corona control and charge corona blocks 22 and 27, respectively, which are shown connected to the control logic circuitry 40. As has been indicated, the control logic circuitry 40 of FIG. 4 includes a microprocessor which is programmed to provide the desired functioning for the copy machine. FIGS. 5, 6 and 7 set forth flow charts which show the operation that is provided and, in particular, the operation that is related to the eddy current detector 15 which is used in the copy machine to prevent the copying of a document which contains metal. The start position 50 of the flow chart indicates turn on of power to the copy machine. The operation then proceeds to the power-up step 51 which, when completed, brings the operation of the circuitry to the point 52 where a determination is made of the condition of the latching relay 42. If the latching relay has been operated due to a detection of metal by the eddy current detector 15 with the drive circuit 41 operated to set the latching relay and the manual reset 43 has not been operated to reset the latching relay, the latching relay 42 will indicate a security error. If a security error condition is presented by the latching relay 42, the control logic circuitry 40 operates to disable the copy machine as indicated at 53 and then sets the security error flag in the control logic circuitry as indicated at 54 with the operation then proceeding to the block 55 which is labeled systems checks. The control logic circuitry 40 then proceeds to the next step 56 for a determination as to whether a sheet is present in the document loader. Such information would be provided by the document loader detector 46. If a document is not present in the document loader, the control logic circuitry 40 returns to step 52 where the latching relay 42 is again interrogated to determine whether it is in a security error position. Since we have assumed it is, steps 53, 54 and 55 are repeated. Having assumed that the latching relay has been operated and has not been reset, the operator of the copy machine will be made aware of this condition in that the audio-visual indicators 44 will have been operated by the latching relay 42. The operator would then reset or arrange to have the latching relay 42 reset via the manual reset input 43. With the latching relay reset, step 52 will indicate that the latching relay has been reset so a security error is not present allowing the control logic circuitry 40 to proceed to step 57 which serves to enable the copy machine. Operation of the control logic circuitry 40 then proceeds to clear any security error flag that may have been present as was indicated at step 58, and then proceeds to step 55 for system checks to be made with step 56 then reached to determine whether a sheet is present in the document loader. Assuming a sheet is present, the control logic circuitry 40 proceeds to step 59 to determine whether the document cover 3 is closed. Whether the document cover is closed is determined by the document cover position indicating device 4 provided in the document cover 3. If the document cover is not closed, the control logic circuitry returns to step 52 which is repeated together with steps 57, 58 and 55 and 56. Once the operator has closed the document cover 3 and with a document sheet present at the document loader, the control logic circuit 40 proceeds to step 60 where a determination is made as to whether step 54 had been used to set a security error flag, which would be the case had the latching relay been operated and had not been reset and a sheet was present in the document loader and the document cover was closed. If a security error flag is detected at step 60, the control logic circuitry 40 returns to step 52. Since we have assumed the latching relay 42 is reset, the control logic circuitry proceeds to step 61 of FIG. 6. At step 61, the document loader control 47 is operated to eject any document sheet that may be present at the platen 2 of the copy machine and move a document from the document loader input to the platen 2 to place it in position for copying. Upon completion of the operation of the document loader at step 61, the control logic circuitry 40 proceeds to step 62 where the motor for the drive apparatus 30, which also functions as the prime mover for the reciprocating drive motor 12, is turned on. With the motor for the drive apparatus 30 turned on, the pulse generator 45 is operative to provide pulses to the control logic circuitry 40 and when the carriage 5 is moved to the point where switch 14 is operated, the control logic circuitry 40 is then conditioned to utilize the pulses from the pulse generator 45. The control circuitry 40 then knows where the carriage 5 and the drum 19 are at any one particular point in time with relation to other elements in the copy machine. The copy process cycle provided by the control logic circuitry 40 to provide a latent image to the photoconductor 18 at the drum 19, as has already been described, can be carried out.

During the steps in the copy process cycle, a subroutine is carried out which is set forth in FIG. 7. This routine is carried out each time a pulse is provided by the pulse generator 45. Referring to step 64 in FIG. 7, the latching relay 42 is checked to determine whether it has been operated in response to the eddy current detector 15 and operation of the drive circuit 14. Referring to FIG. 4 it should be noted that the drive circuit 41 is under the control of the control logic circuitry 40 for receiving an enabling signal for operation of drive circuitry 41 in response to an output from the eddy current detector 15 while the eddy current detector 15 is being moved in scanning relation to the document at the platen 2. The enabling signal is required for the drive circuit 41 since it is desired that it not be responsive to an output provided by the eddy current detector 15 when it reaches a point in the scan where it detects the piece of metal 16 in FIG. 2. Such output from the eddy current detector is used by the control logic circuitry 40 to determine whether the eddy current detector 15 is in an operative condition. In the event the latching relay 64 has not been latched due to the detection of metal at the document presented at platen 2, step 65 is operative to return the operation of the control logic circuitry 40 to the copy process cycle step at 63. If the eddy current detector 15 detects metal at the document presented at the platen 2, the latching relay 42 will be operated to present a security error which will be detected by the control logic circuitry 40 so that the control logic circuitry 40 at step 66 will function to disable the charge corona control 22, the transfer corona control 27 and the developer bias control 48. The control logic circuitry 40 then proceeds to step 67 where the security error flag is set. Step 65 is then reached which returns the process to step 63 for continuation of the copy process cycle. Since the charge corona and transfer corona plus the developer bias have been disabled, the copy process will not be effective to provide a developed image that can be transferred to the receptor sheet that is presented to the photoconductor layer 18 so that the receptor sheet that is presented will be ejected from the copy machine without any image present on the receptor sheet.

Referring once again to the subroutine set forth in FIG. 7, it will be noted that in addition to checking the condition of the latching relay at step 64, the control logic circuitry 40 also provides a check at step 68 to determine whether the document cover 3 has been opened during the copy process established at step 63. If the document cover is not open, the control logic circuitry 40 returns to step 65 indicating the normal process cycle indicated in step 63 should continue. In the event the document cover position indicating device 4 indicates the document cover 3 is open, the control logic circuitry is effective, as in the case of the operation of the latching relay 64, to disable the transfer corona control 27, the charge corona control 22 and the developer bias control 48 with a security error flag set at step 67 before proceeding to step 65 to return to the copy process cycle at step 63. Accordingly, if the document cover 3 is opened during the copy process cycle, the control logic circuit is operative to disable the copying process so the receptor sheet presented to the photoconductor layer on drum 19 will not receive a developed image at the transfer station and will be ejected from the copy machine without an image present on the receptor sheet.

Assuming that the security error flag was not set during the subroutine of FIG. 7, the copy process is completed to provide a copy and the routine established by the control logic circuitry 40 proceeds to step 69 where a check is made with respect to the presence of a security error flag and, if such check is negative, moves to step 70 where a determination is made as to whether the copy that was made is the last copy to be made. If not, the routine returns to step 63. If the last copy has been made, the next step in the operation provided by the control logic circuitry is step 71 where a determination is made as to whether a sheet is present in the document loader. In the event a sheet is present, the document loader is operated at step 72 to eject the document sheet that is present at the platen 2 and present the document to be copied to the platen 72. To assure that the document brought to the platen 2 is in position to assure proper detection of any metal that may be present at the document by the eddy current proximity detctor 15, step 73 provides for a "dead" scan wherein the scanning apparatus and the drum 19 are operated but without any provision made during such a scan for making a copy. Whether this "dead" scan provision is needed is dependent on the speed with which a document is brought into position on the platen 2 so it can be properly examined for metal by the eddy current detector 15. It should be mentioned that the drive apparatus 30 of FIG. 3 is shown operatively connected to the drive rollers 34–35 for the receptor sheets includes a clutch which is timed for operation to bring a receptor sheet to the drum 19 at the proper time. During a "dead" scan the clutch is not engaged to provide a receptor sheet to the drum 19. Upon completion of the "dead" scan at step 73, the control logic circuitry proceeds to step 63 where the copy process cycle is carried out alone with the subroutine of FIG. 7, which has already been described.

Returning to step 71, if a sheet was not indicated to be present in the document loader after completion of step 70, the control logic circuitry proceeds to step 74 to return the procedure to system checks at step 55 of FIG. 5. A return to step 55 via step 74 would also have been accomplished had step 69 determined that a security error flag was set indicating that the latching relay 64 had been set in response to detection of a document at the platen 2 having metal or detection of the document cover 3 being in the open position during the copy process cycle being carried out at step 63.

A copy machine that has been described in connection with the use of a eddy current proximity detector 15 and a document cover position detecting device which operated in accordance with the flow charts set forth and described in connection with FIGS. 5–7, provides a copy machine wherein it is not possible for one to obtain a copy of a document that carries metal. This arrangement allows the copy machine to be adopted by an office wherein security sensitive documents already exist, since such documents can be processed to receive a metal strip that can be secured to the document so it can be detected in the copy machine should an attempt be made to copy it with additional documents that may be published being prepared in a similar manner or with paper containing or having metal secured to it. It is possible to also provide the various security sensitive documents with a type of metal strip that can be detected by a different detection system should an effort be made to remove such a document from a secured area.

Since a document to be copied must be moved by the document loader in the cover 3 to the platen 2, it can be appreciated that the eddy current proximity detector 15 could be located at a point along the path of movement of the document as it is moved to the platen to be copied so that a document that has metal can be detected.

The particulars of the foregoing description are provided merely for purposes of illustration and are subject to a considerable latitude of modification without departing from the novel teachings disclosed therein. Accordingly, the scope of this invention is intended to be limited only as defined in the appended claims, which should be accorded a breadth of interpretation consistent with this specification.

What is claimed:

1. A copy machine of the type having a document cover than can be positioned over a document presented to a platen in the copy machine for copying and having control logic circuitry for controlling the copying process of the copy machine which uses a charge corona control for operation of a charge corona to supply a uniform charge to a photoconductor and a transfer corona control for operation of a transfer corona including:

an eddy current proximity detector having an output connected to the control logic circuitry and positioned so relative movement is provided between said eddy current proximity detector and a document to be copied when the copy machine is operated, said detector adapted for providing a signal at said output whenever metal is presented to the detector via a document presented for copying;

latching means operatively connected to said output of said detector and to the control logic circuitry, said latching means providing a latch condition when the control logic circuitry provides an enable signal to said latching means at the time said output is provided, the control logic circuitry providing an enable signal to said latching means when relative movement is provided between said eddy current proximity detector and a document to be copied such that said eddy current proximity detector will provide a signal to said output due to metal present at the document to be copied; and the control logic circuitry operatively connected to the charge corona control, transfer corona control and to said latching means, said control logic circuitry inhibiting the operation of the charge corona control when said latching means provides a latch condition.

2. A copy machine according to claim 1 further including:

a document cover position detector operatively associated with the document and operatively connected to said control logic circuit for providing an electrical indication of the open-closed status of the document cover, the control logic circuitry requiring said electrical indication to reflect a closed status for the document cover before a copy process cycle can begin and inhibiting the operation of the charge corona control and transfer corona control when a document cover open status is provided by said electrical indication after a copy process cycle has begun.

3. A copy machine according to claim 1 wherein the relative movement provided between said eddy current proximity detector and a document to be copied is provided after the document to be copied is positioned on the platen.

4. A copy machine according to claim 1 wherein said latching means includes a drive circuit operatively connected to said output of said eddy current proximity detector and a latching relay operatively connected to said drive circuit, said latching relay providing said latch condition.

5. A copy machine according to claim 4 wherein said latching relay includes an input for manually initiating the resetting of said latching relay when said latching relay is presenting a latch condition.

6. A copy machine according to claim 1 wherein the relative movement provided between said eddy current proximity detector and a document to be copied is provided by movement of said eddy current proximity detector with the document in position at the platen.

7. A copy machine according to claim 6 wherein the copy machine further includes metal positioned for detection by said eddy current proximity detector during a portion of the movement of said eddy current proximity detector for providing said control logic circuitry with a signal at said output of said eddy current proximity detector when said metal included in the copy machine is detected which is usable to verify operability of said eddy current proximity detector.

8. A copy machine according to claim 7 further including a pulse generator operatively connected for supplying a series of pulses to the control logic circuitry and a position indicator operatively connected to the control logic circuitry and positioned for actuation at a point in the movement of said eddy current proximity detector, said actuation usable by the control logic circuit for providing a starting point for utilization of said series of pulses for determining when said enable signal is provided to said latching means.

* * * * *

UNITED STATES PATENT AND TRADEMARK OFFICE

CERTIFICATE OF CORRECTION

PATENT NO. : 4,486,090

DATED : December 4, 1984

INVENTOR(S) : NICHOLAS WARHOL

It is certified that error appears in the above-identified patent and that said Letters Patent is hereby corrected as shown below:

Claim 2, (column 12, line 6) after "document" insert -- cover --.

Signed and Sealed this

Sixth Day of August 1985

[SEAL]

*Attest:*

DONALD J. QUIGG

*Attesting Officer*

*Acting Commissioner of Patents and Trademarks*